US009509048B2

(12) United States Patent
Kashiwagi

(10) Patent No.: US 9,509,048 B2
(45) Date of Patent: Nov. 29, 2016

(54) ANTENNA APPARATUS AND ELECTRONIC DEVICE INCLUDING THE ANTENNA APPARATUS

(71) Applicant: KABUSHIKI KAISHA TOSHIBA, Minato-ku, Tokyo (JP)

(72) Inventor: Ippei Kashiwagi, Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 11 days.

(21) Appl. No.: 14/726,970

(22) Filed: Jun. 1, 2015

(65) Prior Publication Data

US 2016/0064818 A1 Mar. 3, 2016

Related U.S. Application Data

(60) Provisional application No. 62/043,280, filed on Aug. 28, 2014.

(51) Int. Cl.

| | |
|---|---|
| ***H01Q 5/371*** | (2015.01) |
| ***H01Q 5/378*** | (2015.01) |
| ***H01Q 9/42*** | (2006.01) |

(52) U.S. Cl.

CPC ..... *H01Q 5/371* (2015.01); *H01Q 5/378* (2015.01); *H01Q 9/42* (2013.01)

(58) Field of Classification Search

CPC ..... H01Q 5/364; H01Q 5/371

See application file for complete search history.

(56) References Cited

U.S. PATENT DOCUMENTS

| | | | |
|---|---|---|---|
| 7,136,022 | B2 | 11/2006 | Sato et al. |
| 7,477,199 | B2 | 1/2009 | Hotta et al. |
| 7,791,546 | B2 | 9/2010 | Hotta et al. |
| 8,941,548 | B2 | 1/2015 | Kashiwagi et al. |
| 2008/0169981 | A1 | 7/2008 | Hotta et al. |
| 2009/0079639 | A1 | 3/2009 | Hotta et al. |
| 2012/0249393 | A1 | 10/2012 | Hotta et al. |
| 2013/0050036 | A1 | 2/2013 | Kashiwagi et al. |
| 2013/0257681 | A1 | 10/2013 | Kashiwagi et al. |
| 2013/0285870 | A1 | 10/2013 | Hotta et al. |
| 2014/0354484 | A1 | 12/2014 | Kashiwagi et al. |
| 2014/0354489 | A1 | 12/2014 | Kashiwagi |

FOREIGN PATENT DOCUMENTS

| | | | |
|---|---|---|---|
| JP | 3775795 | B1 | 5/2008 |
| JP | 2008-177668 | A | 7/2008 |
| JP | 4233100 | B2 | 3/2009 |
| JP | 4643624 | B2 | 3/2011 |
| JP | 2012-213231 | A | 11/2012 |
| JP | 5127966 | B1 | 1/2013 |

(Continued)

*Primary Examiner* — Robert Karacsony

(74) *Attorney, Agent, or Firm* — Foley & Lardner LLP

(57) ABSTRACT

According to one embodiment, an antenna includes a second element that has an end connected to a first point of a first element, and first and second ends kept open, and includes a first portion extending from a feed terminal to the first end, and a second portion extending from the feed terminal and bifurcated at a second point between the first point and the first end. The lengths of the first and second portions are set to substantially ¼ of a resonance frequency, and substantially ¾ of a resonance frequency, severally. The second portion includes a portion extending from the feed terminal to the second point, and a portion extending from the second point to the second end and interposed between the portion and a ground.

10 Claims, 12 Drawing Sheets

(56) References Cited

FOREIGN PATENT DOCUMENTS

| | | | |
|---|---|---|---|
| JP | 2013-229823 | A | 11/2013 |
| JP | 5380569 | B2 | 1/2014 |
| JP | 5404882 | B1 | 2/2014 |
| JP | 5404888 | B1 | 2/2014 |
| JP | 2014-235517 | A | 12/2014 |
| JP | 2014-236323 | A | 12/2014 |

ANTENNA APPARATUS AND ELECTRONIC DEVICE INCLUDING THE ANTENNA APPARATUS

CROSS-REFERENCE TO RELATED APPLICATIONS

This application claims the benefit of U.S. Provisional Application No. 62/043,230, filed Aug. 28, 2014, the entire contents of which are incorporated herein by reference.

FIELD

Embodiments described herein relate generally to an antenna apparatus and an electronic device including the antenna apparatus.

BACKGROUND

An antenna apparatus provided with a plurality of antenna elements and hence having a wide-bandwidth compatibility is known.

Further, an antenna apparatus is known, in which impedance characteristic associated with the resonance frequency band of an antenna element that covers a high-frequency band is improved to thereby reduce the frequencies in the resonance frequency band and enable the antenna apparatus to be made compact.

There is a demand for an antenna apparatus that has a wider-bandwidth compatibility and can be made compact.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, an antenna apparatus comprises a first antenna element, a second antenna element and a capacitor element. The first antenna element has an end connected to a feed terminal and another end kept open, an element length ranging from the feed terminal to the another end being set to substantially a quarter of a wavelength corresponding to a preset first resonance frequency. The second antenna element has an end connected to a first point of the first antenna element, and a first other end and a second other end kept open. The second antenna element includes a first antenna portion and a second antenna portion. The first antenna portion extends from the feed terminal to the first other end, and the element length of the first antenna portion is set to substantially a quarter of a wavelength corresponding to a preset second resonance frequency. The second antenna portion extends from the feed terminal and bifurcated from the first antenna portion at a second point between the first point and the first other end at the path of the first antenna portion. The element length of the second antenna portion is set to substantially ¾ of a wavelength corresponding to a preset third resonance frequency. A capacitor element is provided between the feed terminal and the first point. The second antenna portion includes a first portion extending from the feed terminal to the second point, and a second portion extending from the second point to the second other end. The second portion is interposed between the first portion and a ground portion.

In this specification, different expressions are imparted as examples to each of some elements. However, note that their names are not limited to the imparted ones, but other expressions may be imparted.

Similarly, elements, each of which is not expressed by a plurality of expressions, may be referred to as other names.

Further, the figures attached herewith are schematic ones, in which the dimensional relationship between thicknesses and planar sizes, and the ratio in thickness between layers, may differ from the actual ones. Yet further, the relationships in dimension, the ratio in thickness between layers, etc., may vary between the figures.

Hereinafter, embodiments are explained with reference to the accompanying drawings.

First Embodiment

Figure 1:
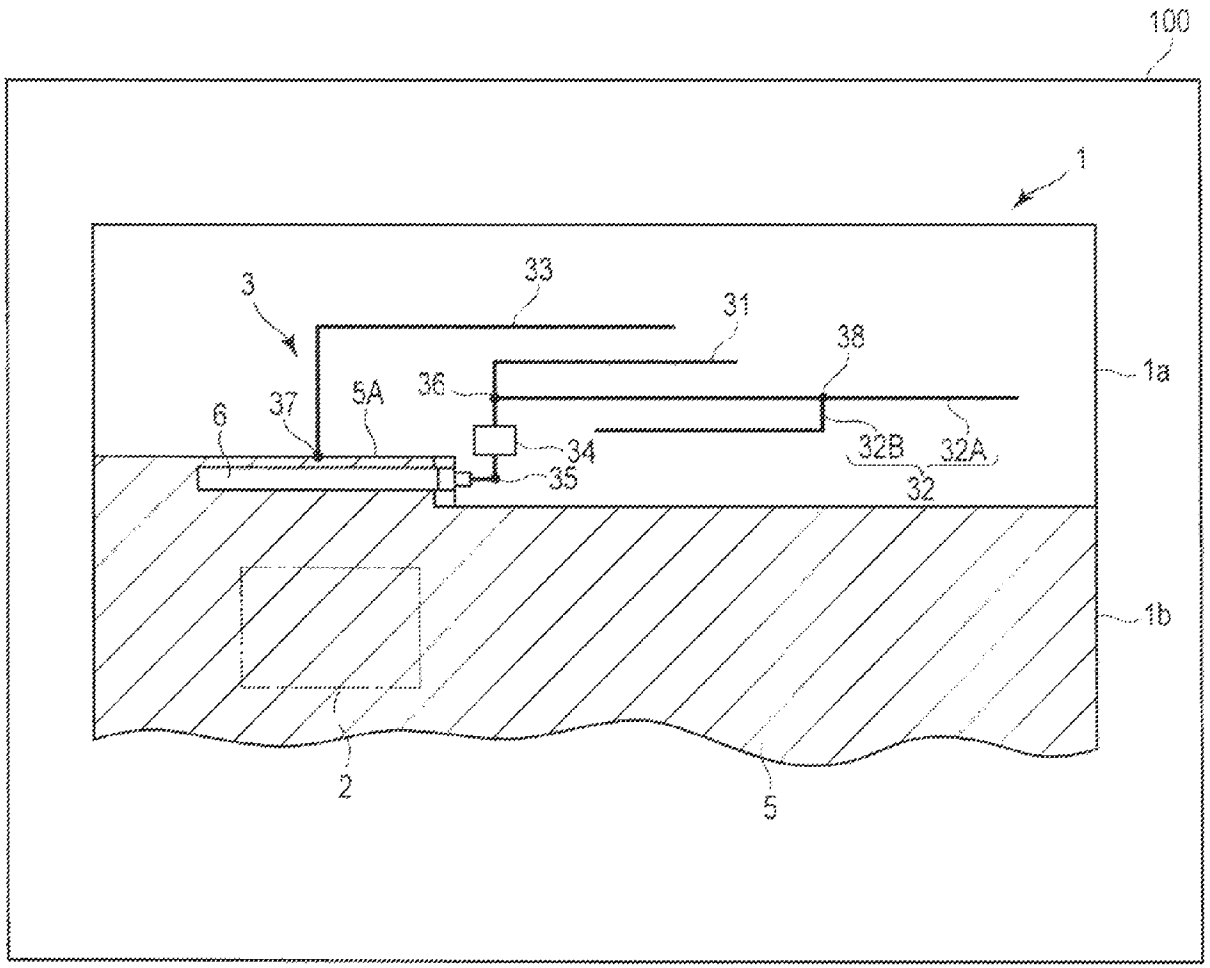
FIG. 1 shows a structure example of an essential part of an electronic device with an antenna apparatus according to a first embodiment.

FIG. 1 shows a structure example of an essential part of an electronic device 100 with an antenna apparatus according to a first embodiment.

As shown in FIG. 1, the electronic device 100 is a notebook personal computer or a touch-panel mobile information terminal, which has a wireless interface, and comprises a printed circuit board 1. The electronic device 100 may be another typo of mobile terminal, such as a mobile phone, a smartphone, a personal digital assistant (PDA), an electronic beck terminal or a game terminal. Further, the printed circuit board 1 may be formed as part of a metal casing, or formed of a metal member, such as copper foil.

The printed circuit board 1 has a first area 1*a* and a second area 1*b*. The first area 1*a* is provided with an antenna apparatus 3, and the second area 1*b* in provided with a ground pattern (ground portion) 5. The ground pattern 5 has a stepped portion 5A, along which a high-frequency cable 6 is extended.

A plurality of circuit modules necessary to form the electronic device 100 are mounted on the reverse surface of the printed circuit board 1. The circuit modules Include a wireless unit 2. The wireless unit (wireless transceiver) 2 has a function of transmitting and receiving wireless signals of frequencies corresponding to a plurality of channel frequencies assigned to a wireless system as a communication target.

The antenna apparatus 3 is constructed as below.

Namely, the antenna apparatus 3 comprises an antenna element (first antenna element) 31, a bifurcated element 32 (second antenna element) formed of a monopole element, and an antenna element (third antenna element) 33.

The antenna element 31 has an end connected to the feed point (feed terminal) 35 of the high-frequency cable 6, and the other end open. Further, the antenna element 31 has an element length ranging from the feed point 35 to the open end and being substantially a quarter of a wavelength corresponding to a preset first resonance frequency.

The first resonance frequency falls within a 1.8 GHz band (e.g., 1.7 GHz to 1.9 GHz). The frequency of the 1.8 GHz band is used by, for example, a 3G-standard wireless system.

The antenna element 31 includes a bifurcated point (hereinafter referred to as the first point) 36, and a capacitor element 34 interposed between the bifurcated point 36 and the feed point 35. As the capacitor element 34, a 2.2 pF capacitor element is used, for example. Further, it is desirable to provide the capacitor element 34 near the feed point 35.

The bifurcated, element 32 is an antenna element bifurcated from the first point 36 of the antenna element 31. The bifurcated element 32 comprises a linearly extending portion (hereinafter, a linear portion; first antenna portion) 32A, and a portion (hereinafter, an inverse-L-shaped portion; second antenna portion) 32B extending like an inverse L-shape from a preset point (hereinafter, a second point) 38 positioned on the linear portion 32A between the first point 36 and the other end or the linear portion 32A.

Further, in the bifurcated element 32, one end of the linear portion 32A is connected to the first point 36 of the antenna element 31, and the other end (first other end) of the linear portion 32A and the distal end (second other end) of the inverse-L-shaped portion 32B are kept open. The element length of the linear portion 32A ranging from the feed point 35 to its open end is set to substantially a quarter of the wavelength corresponding to a preset second resonance frequency. The element length of the inverse-L-shaped portion 32B from the feed point 35 to its open end is set to substantially three quarters of the wavelength corresponding to a preset third resonance frequency.

The inverse-L-shaped portion 320 has a first portion (extending from the feed point 35 to the first point 36) shared with the linear portion 32A, and a second portion extending from the second point 38 to the other end of the portion 32B. The second portion of the inverse-L-shaped portion 32B is positioned between the first portion and the ground pattern 5.

In the first embodiment, the second resonance frequency falls within an 800 KHz band (e.g., 700 MHz to 900 MHz). The frequencies in the 800 MHz band are used by, for example, a wireless system that employs LTE (Long Term Evolution). Further, the third resonance frequency falls within a 2.6 GHz band (e.g., 2.5 GHz to 2.7 GHz). The frequencies in the 2.6 GHz band are used by, for example, a wireless system that employs next-generation LTE.

The linear portion 32A of the bifurcated element 32 extends from the first point 36 in parallel with the ground pattern 5. The inverse-L-shaped portion 32B extends by a predetermined distance perpendicularly to the ground pattern b from the second point 38, and further extends between the antenna element 31 and the ground pattern 5 in parallel with them. Thus, the linear portion 32A and the portion of the inverse-L-shaped portion 32B parallel thereto are arranged in parallel with the ground pattern 5. In the bifurcated element 32 constructed as the above, the wavelength corresponding to the resonance frequency of the linear portion 32A is substantially a quarter of the wavelength corresponding to the second resonance frequency, and the wavelength corresponding to the resonance frequency of the inverse-L-shaped portion 32B is substantially three quarters of the wavelength corresponding to the second resonance frequency. Accordingly, waves do not offset each other at the linear portion 32A and the above-mentioned portion of the inverse-L-shaped portion 32B.

The antenna element 33 has one end connected to a passive terminal 37 provided at a stepped portion 5A, and the other end kept open. The element length of the antenna element 33 from the passive terminal 37 to the other end is set to substantially a quarter of a wavelength corresponding to a preset fourth resonance frequency.

In the first embodiment, the fourth resonance frequency falls within a 2.0 GHz band (1.9 GHz to 2.1 GHz). The 2.0 GHz band is used by, for example, a 3G-standard wireless system.

Figure 2:
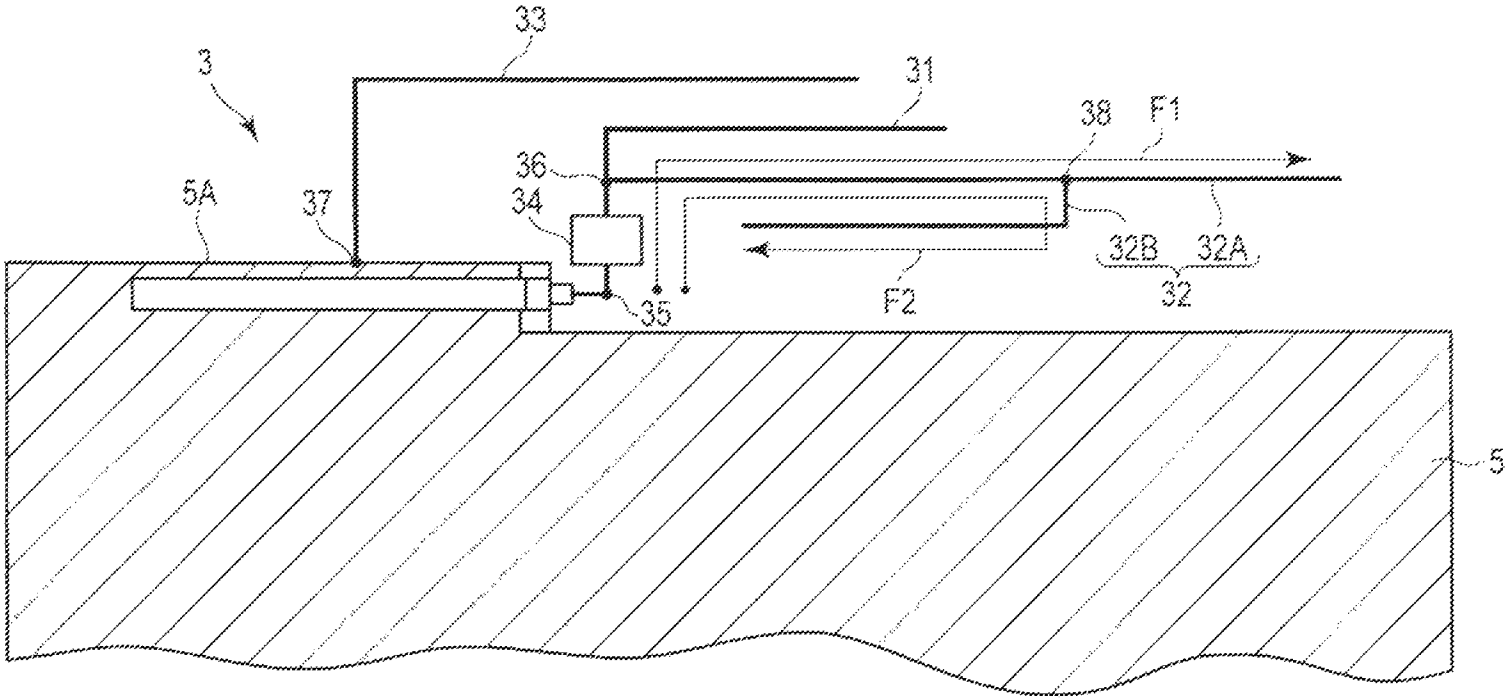
FIG. 2 is a view for explaining an example of a current flow occurring when bifurcated elements according to the first embodiment are resonating.

FIG. 2 is a view for explaining an example of a current that flows when the bifurcated element 32 is resonating.

As shown in FIG. 2, two currents F1 and F2 occur in the bifurcated element 32. The current F1 flows when a resonance of 800 MHz occurs. The current F1 flows from the feed point 35 to the distal end of the linear portion 32A through the capacitor element 34 and the first and second points 36 and 38. Similarly, the current F2 flows when a resonance in the 2.6 GHz band occurs. The current F2 flows from the feed point 35 to the distal end of the inverse-L-shaped portion 32B through the capacitor element 34 and the first and second points 36 and 38. The wavelength of the current F2 is substantially three quarters of the wavelength corresponding to the second resonance frequency, and the current F2 resonates with the second resonance frequency.

Figure 3:
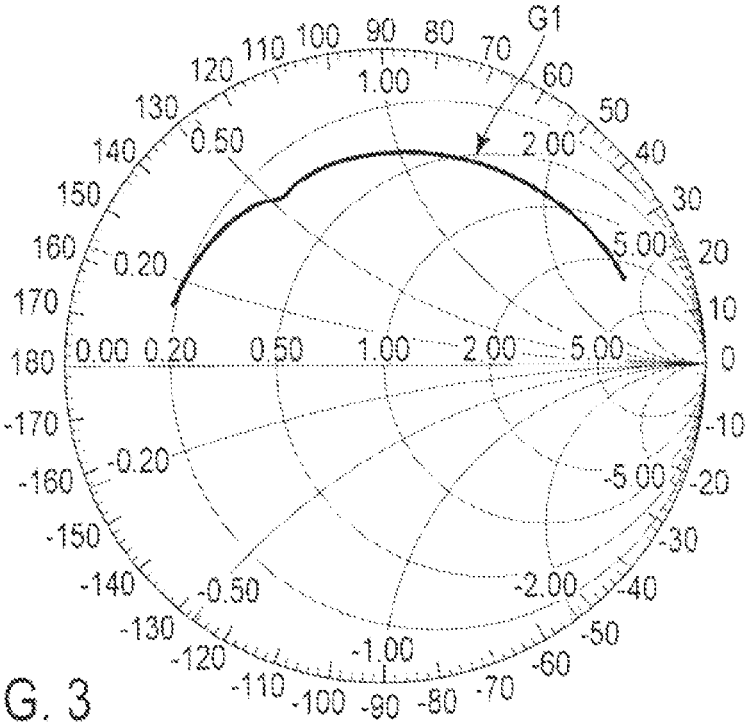
FIG. 3 shows a Smith chart example of an 800 MHz band obtained when a capacitor element is detached from the antenna apparatus or the first embodiment.
Figure 4:
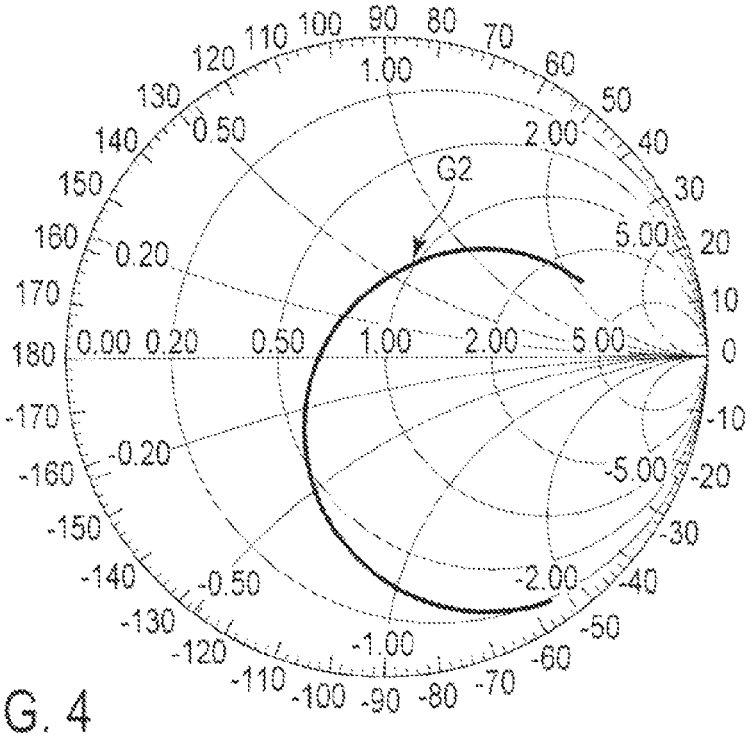
FIG. 4 shows a Smith chart example of an 800 MHz band in the antenna apparatus of the first embodiment.

Referring then to FIGS. 3 and 4, a description will be given of an antenna characteristic example of the antenna apparatus 3 in the 800 MHz band. As described above, the 800 MHz band is where the antenna apparatus resonates using the linear portion 32A of the bifurcated element 32.

FIG. 3 is a Smith chart example in the 800 MHz band of the antenna apparatus 3, obtained when the capacitor element 34 is removed from the antenna apparatus 3 shown in FIG. 1. FIG. 4 is a Smith chart example in the 800 MHz band of the antenna apparatus 3.

In general, a Smith chart indicates that the closer to the center (position: 1.00) of the circle, the higher the degree of matching with 50Ω. Therefore, as is evident from graph curve G1 in FIG. 3 and graph curve G2 in FIG. 4, the antenna apparatus 3 (see FIG. 4) having the capacitor element 34 exhibits a higher matching with 50Ω than an antenna apparatus (see FIG. 3) having no capacitor element 34. Namely, since the antenna apparatus 3 has the capacitor element 34, higher marching with the resistor can be realized in the 800 MHz band.

Figure 5:
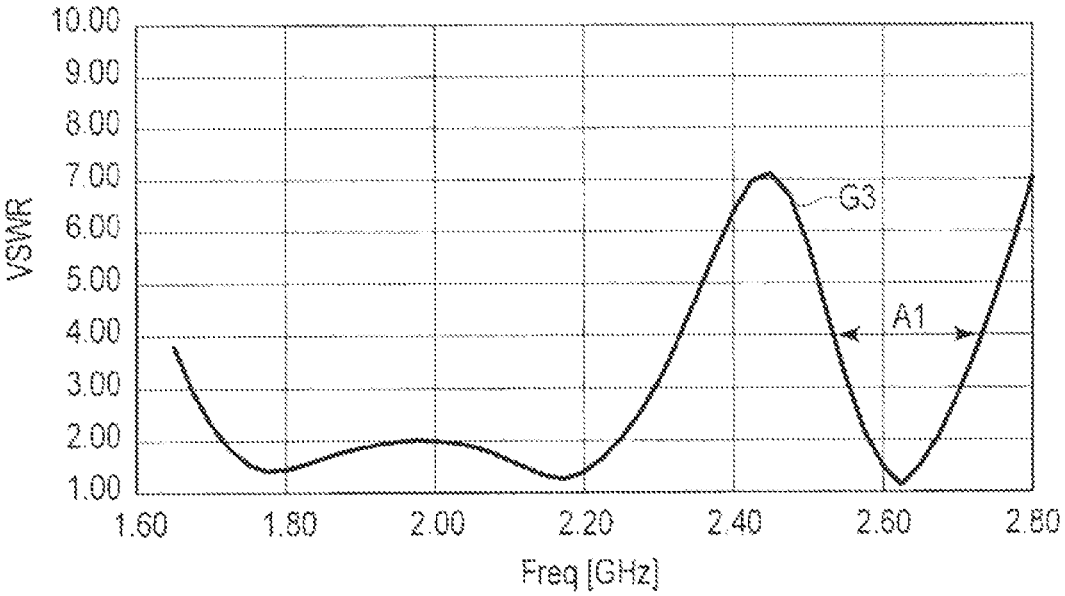
FIG. 5 shows a VSWR frequency characteristic example of the antenna apparatus of the first embodiment.
Figure 6:
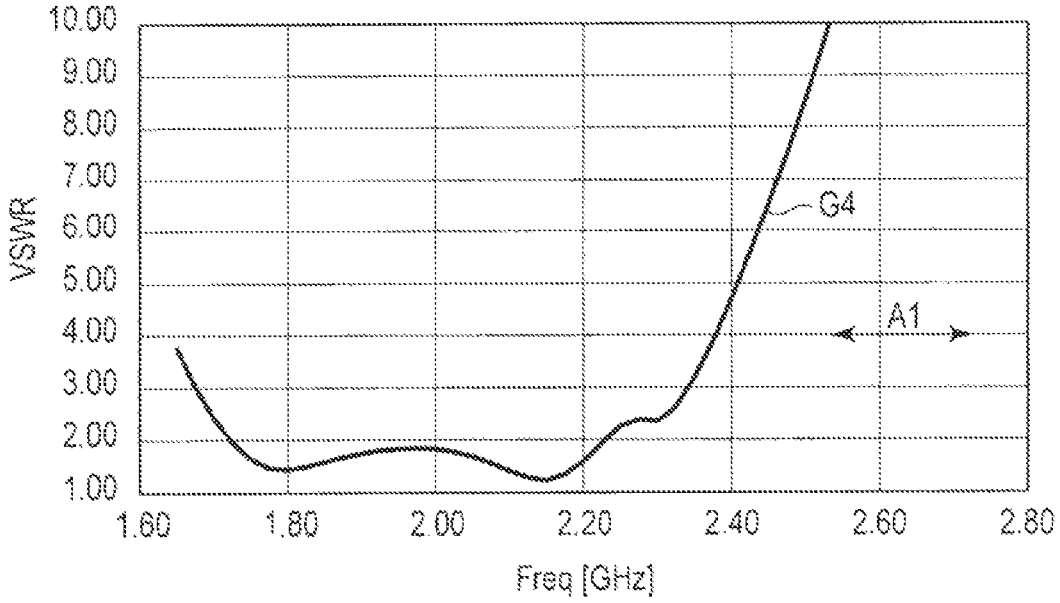
FIG. 6 shows a VSWR frequency characteristic example obtained when an inverse-L-shaped portion is removed from the bifurcated element of the antenna apparatus of the first embodiment.

Referring then to FIGS. 5 and 6, VSWR frequency characteristic examples in the 2.6 GHz band of the antenna apparatus 3 will be described. As described above, the 2.6 GHz band is where the antenna apparatus resonates using the inverse-L-shaped portion 32B.

FIG. 5 shows a VSWR frequency characteristic example of the antenna apparatus 3. FIG. 6 shows a VSWR frequency characteristic example of the antenna apparatus 3 obtained when the bifurcated element 32 has no inverse-L-shaped portion 32B.

In general, the VSWR frequency characteristic means that impedance matching is higher when its value is closet to 1.00. Accordingly, as is evident from curve G3, curve G4, and arrows A1 indicative of the 2.6 GHz band in FIGS. 5 and 6, a higher impedance matching is realized in the 2.6 GHz band when the antenna apparatus 3 has the inverse-L-shaped portion 32B (see FIG. 5), than when the apparatus 3 has no inverse-L-shaped portion 32B.

The antenna apparatus 3 constructed as the above can resonate with the 1.8 GHz band using the antenna element 31, with the 800 MHz band and the 2.6 GHz bend using the bifurcated element 32, and with the 2.0 GHz band using the antenna element 33. Thus, the antenna apparatus 3 can be made to resonate with a wide frequency band.

Further, since the bifurcated element 32 can resonate with both the 800 GHz band and the 2.6 GHz band, it is not necessary to employ another antenna element that resonates with the 2.6 GHz band. Yet further, since the linear portion 32A and the long portion (i.e., the horizontal portion in the figures) of the inverse-L-shaped portion are arranged in parallel with each other, the width of the portion perpendicular to the ground pattern 5 can be reduced. Accordingly, the antenna apparatus 3 can be made compact, in other words, can be prevented from increasing in size, with its resonance range kept wide.

Also, the inverse-L-shaped portion 32B of the bifurcated element 32 has an open distal end. This makes it easy to adjust the electrical length of the element so as to resonate the element with the 2.6 GHz band. Furthermore, the wavelength (substantially three quarters of the wavelength corresponding to the second resonance frequency) is made different from a wavelength (substantially a quarter of the wavelength corresponding to the second resonance frequency) which resonates with another frequency band. Therefore, even if the element length is adjusted, this does not influence the other frequency bands, with the result that resonance adjustment in the 2.6 GHz band can be made independently of the other frequency bands.

Figure 7:
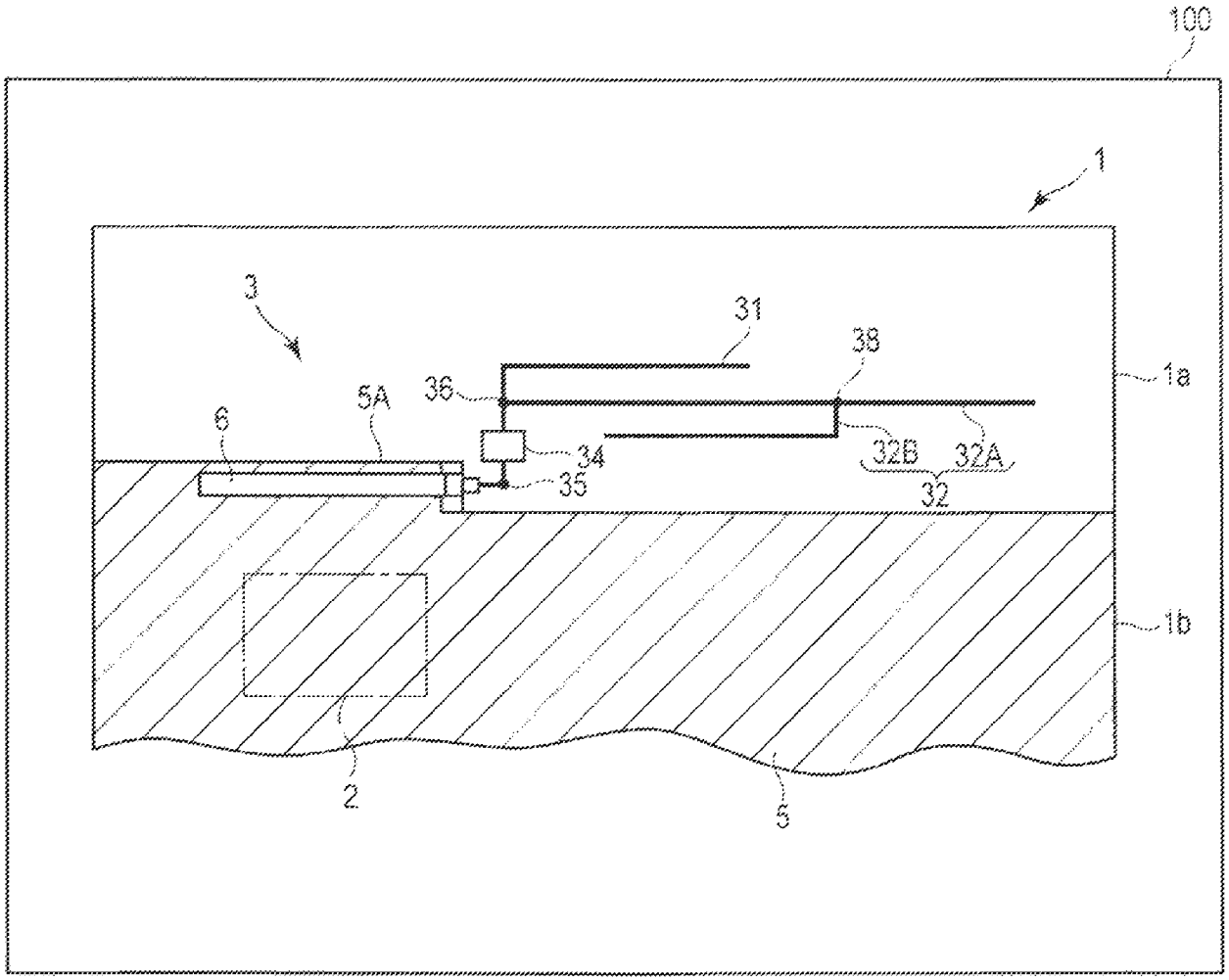
FIG. 7 shows a modification of the electronic device of the first embodiment.

Although in the first embodiment, the antenna apparatus 3 comprises three antenna elements, i.e., the antenna element 31, the bifurcated element 32 and the antenna element 33, the structure of the antenna apparatus is not limited to it. The antenna apparatus may have such a structure as shown in FIG. 7, in which no antenna element 33 is employed, and only the antenna element 31 and the bifurcated element 32 are employed. Even this structure enables, by virtue of the bifurcated element 32, the antenna apparatus to be made to resonate with a band including the 2.6 GHz band and to be made compact. Further, adjustment of resonance in the 2.6 GHz band can be performed independently of the other frequency bands.

Second Embodiment

Figure 8:
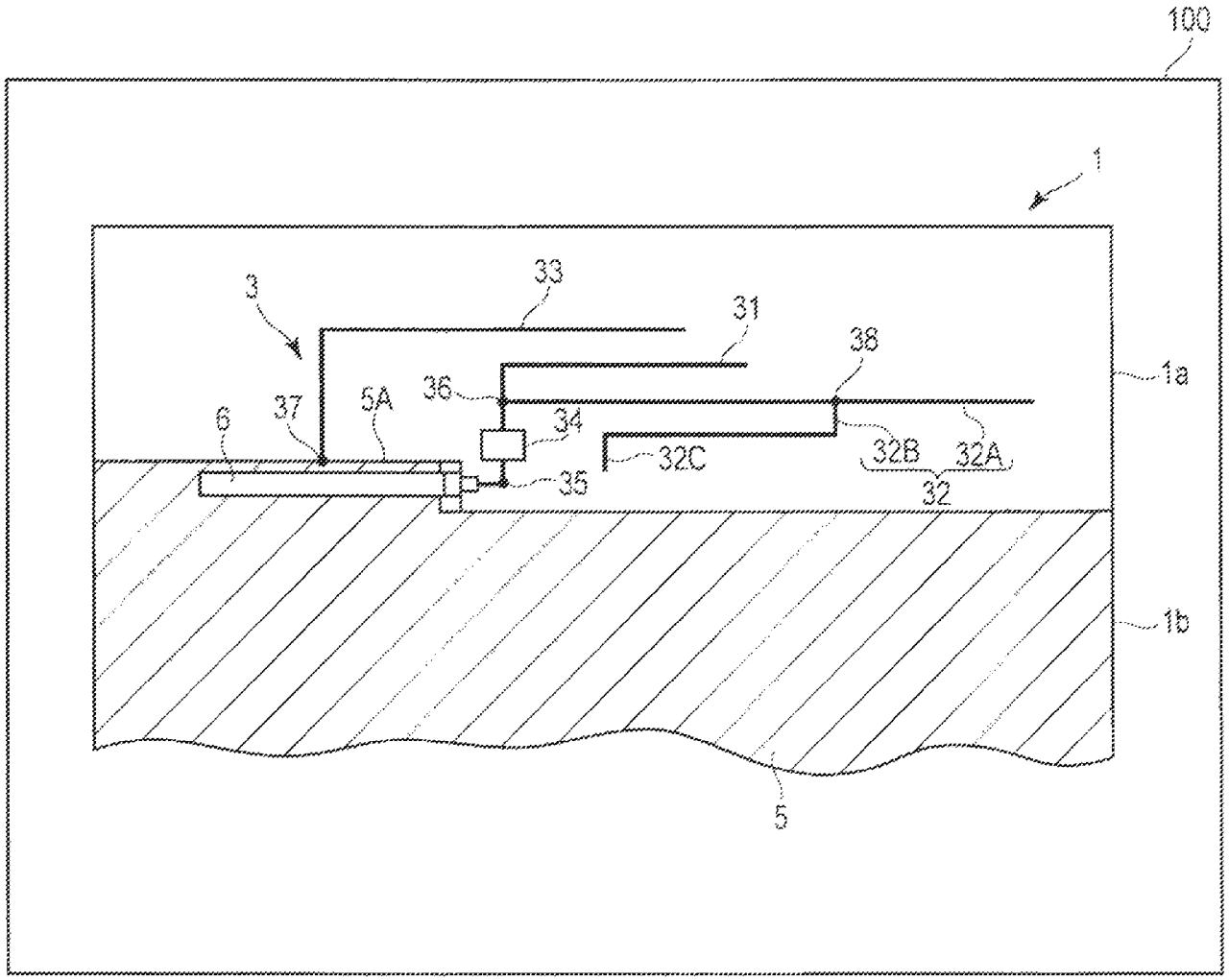
FIG. 8 shows a structure example of an antenna apparatus according to a second embodiment.

FIG. 8 shows a structure example of an antenna apparatus 3 according to a second embodiment. The antenna apparatus of the third embodiment differs from that of the first embodiment in the structure of the bifurcated element 32. Therefore, the structure of the bifurcated element 32 will be described in detail.

Further, in the second embodiment, elements similar to those of the first embodiment are denoted by corresponding reference numbers. Similarly, in third to fourteenth embodiments described later, elements similar to those of the first embodiment are denoted by corresponding reference numbers.

As shown in FIG. 8, an inverse-L-shaped portion 32C is obtained by forming the open distal end of the inverse-L-shaped portion 32B (see FIG. 1) downwardly perpendicular to the ground pattern 5. By thus forming the distal end of the inverse-L-shaped portion 32C to have an angled portion, the impedance can be varied based on the length of the angled portion, i.e., based on the distance between the distal end of the angled portion and the ground pattern 5.

By thus adjusting the length of the angled portion of the inverse-L-shaped portion 32C, the element length of the element can be easily adjusted, and the impedance for resonance in the 2.6 GHz band can be varied. As a result, in the resonance in the 2.6 GHz band, high impedance matching can be easily achieved.

Third Embodiment

Figure 9:
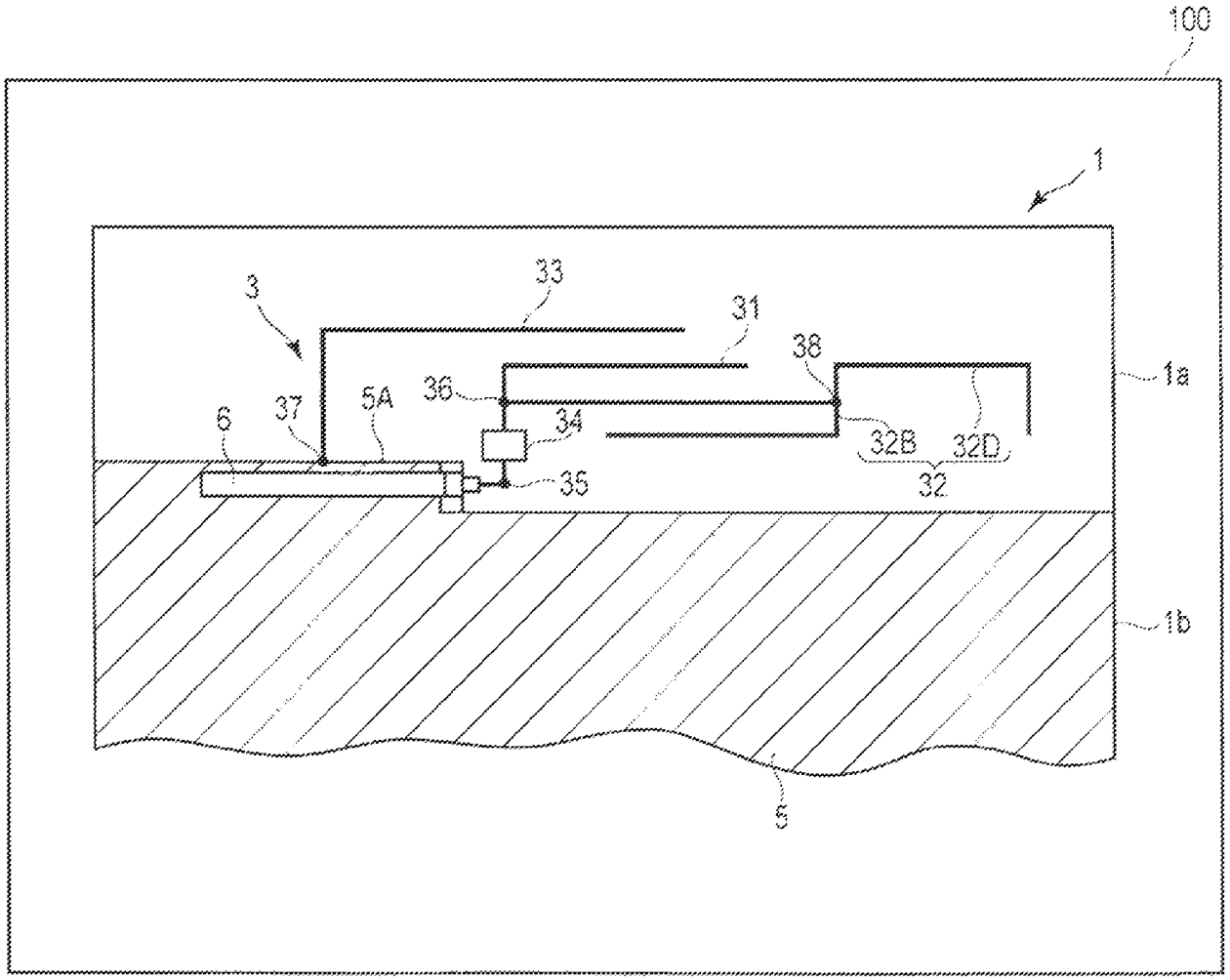
FIG. 9 shows a structure example of an antenna apparatus according to a third embodiment.

FIG. 9 shows a structure example of an antenna apparatus according to a third embodiment. The antenna apparatus of the third embodiment differs from that of the first embodiment in the structure of the bifurcated element 32. Therefore, the structure of the bifurcated element 32 will be described.

As shown in FIG. 9, the bifurcated element 32 has an end portion 320 obtained by angling the linear portion 32A of the first embodiment in few positions, thereby forming a U-shaped portion having sharp corners. More specifically, the end portion 32D comprises a portion 1 extending from the second point 38 away from the ground pattern 5, a portion 2 extending from the portion 1 in parallel with the ground pattern 5, and a portion 3 extending from the portion 2 toward the ground pattern 5. The portion 3 is an open end.

In the above structure, the element length can be adjusted and the impedance used for resonance in the 800 MHz band can be varied by adjusting the length of each portion included in the U-shaped end portion 32D with sharp corners. As a result, during resonance in the 800 MHz band, high impedance matching can be easily realized.

Fourth Embodiment

FIG. 1D shows a structure example of an antenna apparatus 3 according to a fourth embodiment. The antenna apparatus of the fourth embodiment differs from that of the first embodiment in the structure of the bifurcated element 32. Therefore, the structure of the bifurcated element 32 will be described.

Figure 10:
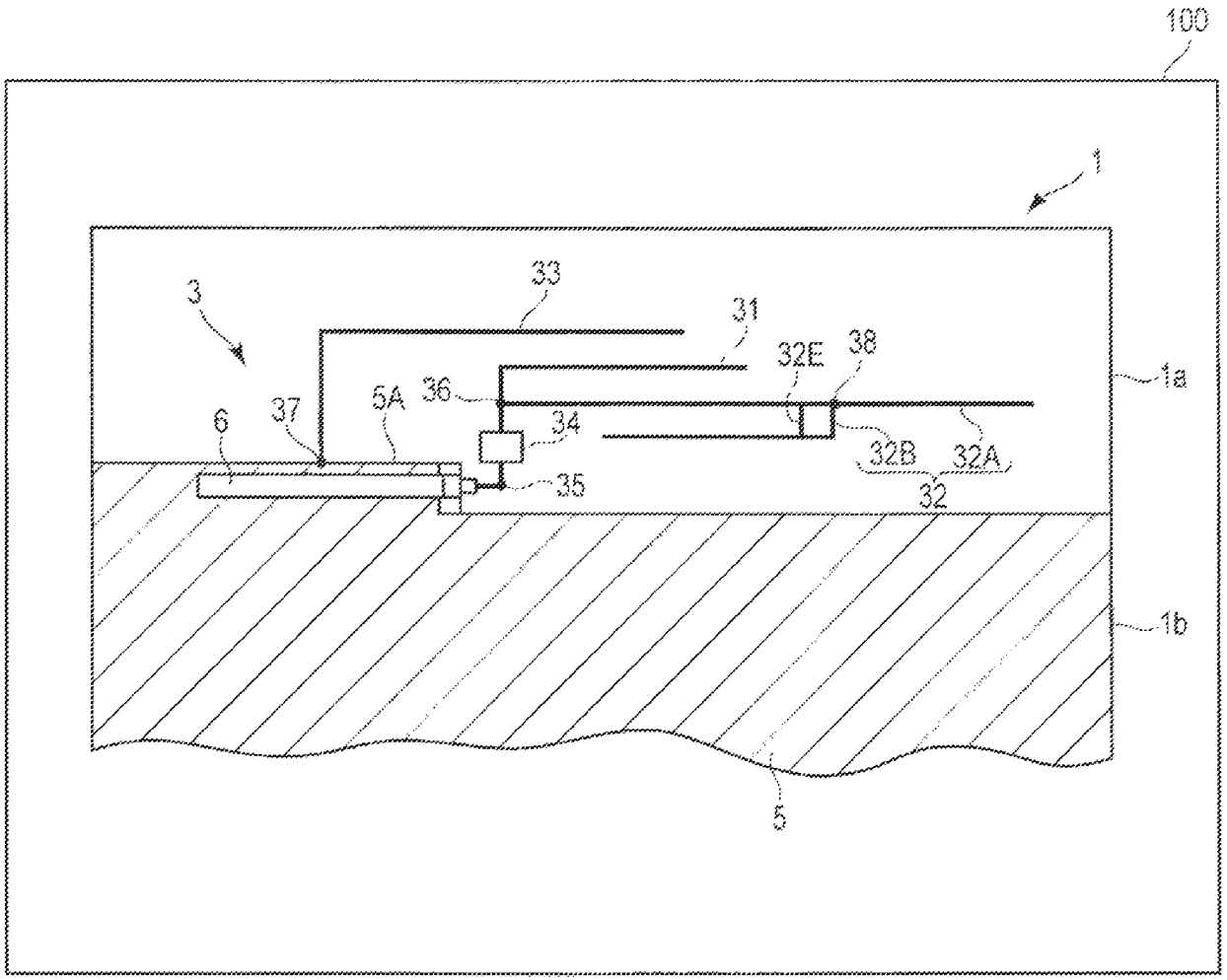
FIG. 10 shows a structure example of an antenna apparatus according to a fourth embodiment.

As shown in FIG. 10, the bifurcated element 32 has a short-circuited element 32E between the linear portion 32A and the inverse-L-shaped portion 32B. More specifically, the short-circuited element 32E extends perpendicularly to the ground pattern 5 from a position that is interposed between the first point 36 and the second point 38 of the linear portion 32A and is much nearer to the second point than to the first point. Further, the short-circuited element 32E connects with the longer portion (i.e., the horizontal portion in the figure) of the inverse-L-shaped portion 32B.

In the above structure, the element length for resonance in the 2.6 GHz band can be adjusted and the impedance for the resonance in the 2.6 GHz band can be varied, by adjusting the position of the short-circuited element 32E. As a result, during resonance in the 800 MHz band, high impedance matching can be easily realized.

Fifth Embodiment

Figure 11:
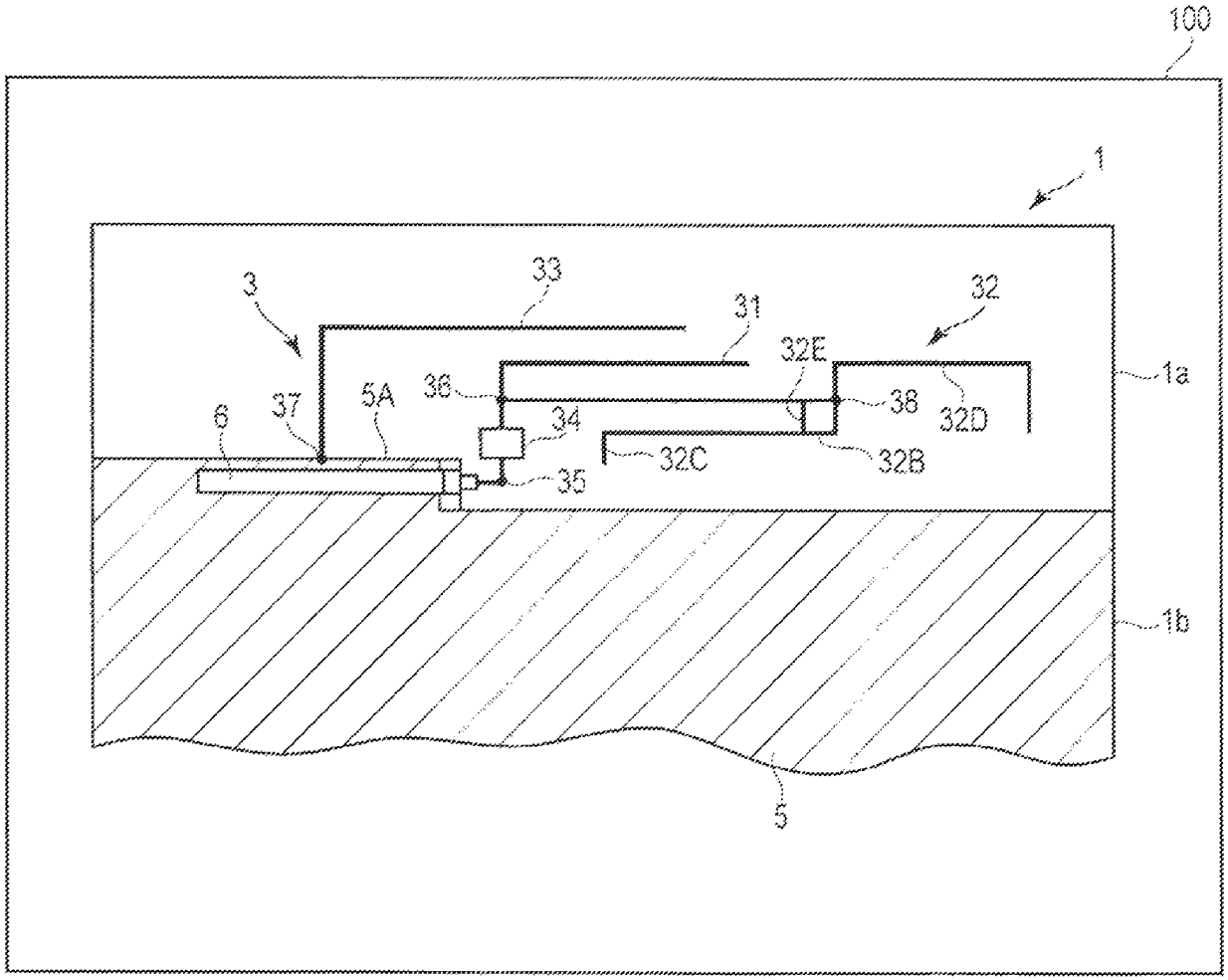
FIG. 11 shows a structure example of an antenna apparatus according to a fifth embodiment.

FIG. 11 shows a structure example of an antenna apparatus 3 according to a fifth embodiment. The antenna apparatus of the fifth embodiment differs from that of the first embodiment in the structure of the bifurcated element 32. Therefore, the structure of the bifurcated element 32 will be described.

As shown in FIG. 11, the bifurcated element 32 has an angled portion (see FIG. 8) 32C, a U-shaped end portion (see FIG. 9) 32D having sharp corners, and a short-circuited element (see FIG. 10) 32B. In this structure, the element length for resonance in the 800 MHz band can be adjusted by adjusting the length of each portion of the U-shaped end portion 32D having sharp corners, and the element length for resonance in the 2.6 GHz band can be adjusted by adjusting the length of the angled portion 32C and the position of the short-circuited element 32E. Further, a high impedance matching can be easily realized in each of those frequency bands.

As described above, the antenna apparatus 3 comprises a plurality of structures for adjusting resonance, i.e., the angled portion (see FIG. 8) 32C, the U-shaped end portion (see FIG. 9) 32D having sharp corners, and the short-circuited element (see FIG. 10) 32E. Therefore, even if the antenna apparatus 3 is mounted in various types of electronic devices 100, it can be easily adapted for both the 800 MHz band and the 2.6 GHz band. Namely, the antenna apparatus 3 can be mounted in various electronic devices 100.

Sixth Embodiment

Figure 12:
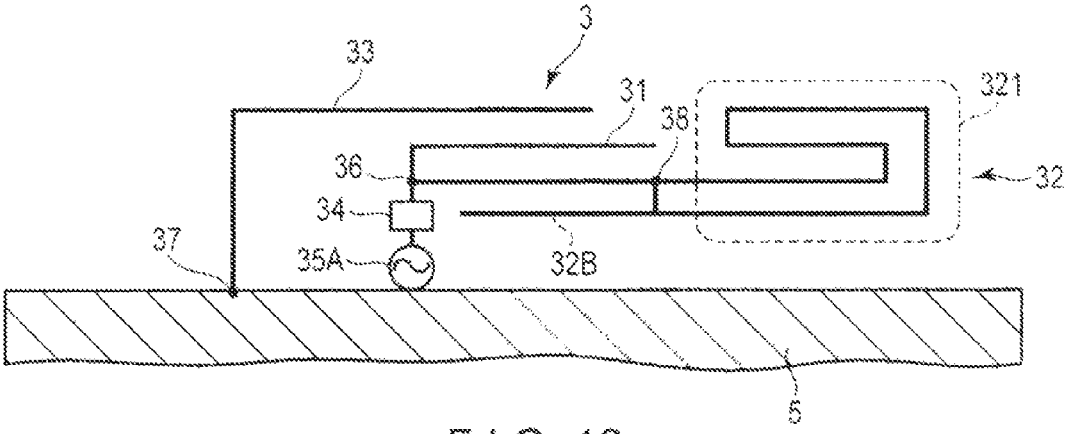
FIG. 12 shows a structure example of an antenna apparatus according to a sixth embodiment.

FIG. 12 shows a structure example of an antenna apparatus 3 according to a sixth embodiment. The antenna apparatus 3 of the sixth embodiment differs from that of the first embodiment in the structure of the bifurcated element 32. Therefore, the structure of the bifurcated element 32 will be described.

In the sixth embodiment to a fourteenth embodiment, the ground pattern 5 does not have the stopped portion 5A, and the bifurcated element 32 is provided via a fend terminal 35A.

As shown in FIG. 12, the bifurcated element 32 has a folded structure. The folded structure means a structure in which, for example, an end of the linear portion 32A is folded to constitute a portion of the inverse-L-shaped portion 32B, and another portion of the inverse-L-shaped portion 32B forms a short-circuited element.

An end portion 321 of the bifurcated element 32 having the folded structure is angled. More specifically, the end portion 321 is angled away from the ground pattern 5 (i.e., angled upward in the figure).

Even by forming the end portion 321 of the bifurcated element 32 like the above, the electrical length for resonance in the 800 MHz band and the electrical length for resonance in the 2.6 GHz band can be adjusted. As a result, high impedance matching man be easily realized during resonance in the 800 MHz band and the 2.6 GHz band.

Seventh Embodiment

Figure 13:
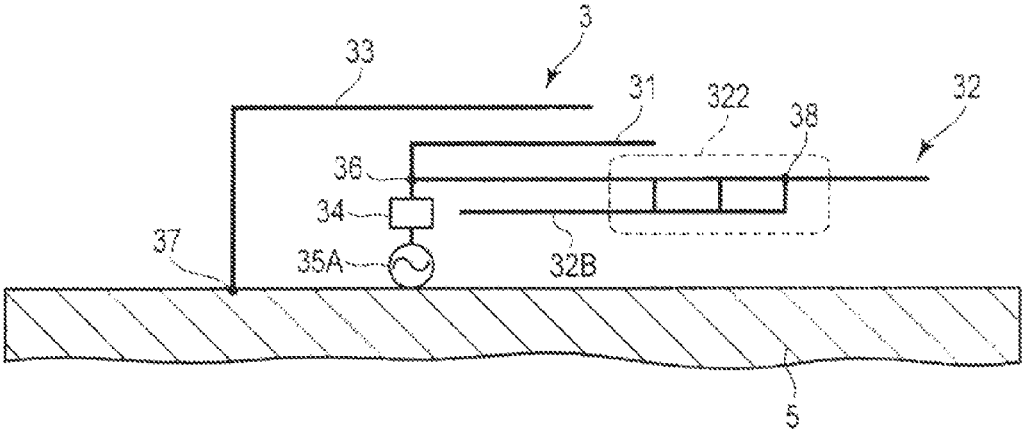
FIG. 13 shows a structure example of an antenna apparatus according to a seventh embodiment.

FIG. 13 shows a structure example of an antenna apparatus 3 according to a seventh embodiment. The antenna apparatus 3 of the seventh embodiment differs from that of the first embodiment in the structure of the bifurcated element 32. Therefore, the structure of the bifurcated element 32 will be described.

As shown in FIG. 13, the bifurcated element 32 has two short-circuited elements as indicated by reference number 322. More specifically, the linear portion 32A is connected to the portion of the inverse-L-shaped portion 32B parallel to the linear portion, by means of the two short-circuited elements, and the other portion of the inverse-L-shaped portion 32.

By adjusting the positions of the two short-circuited elements of the bifurcated element 32, the electrical length for resonance in the 2.6 GHz band can be adjusted.

Although the seventh embodiment employs two short-circuited elements, it may three or more short-circuited elements.

Eighth Embodiment

Figure 14:
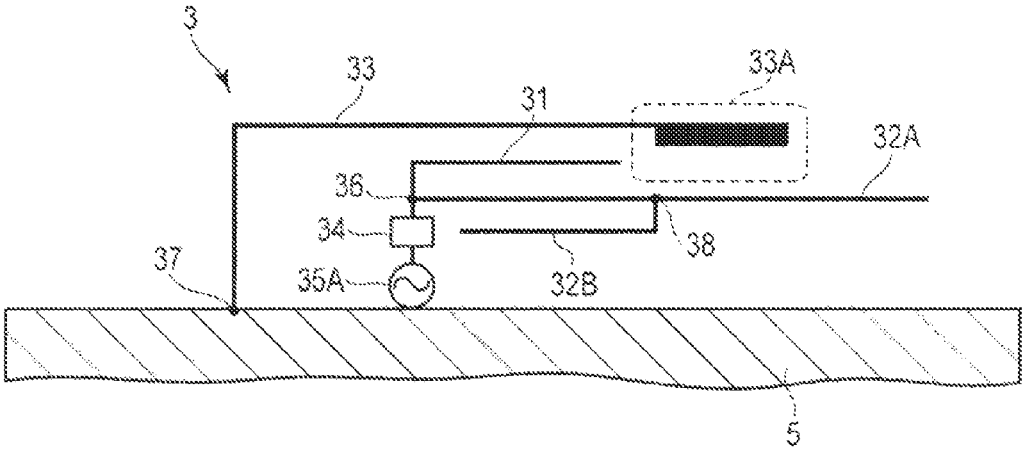
FIG. 14 shows a structure example of an antenna apparatus according to an eighth embodiment.

FIG. 14 shows a structure example of an antenna apparatus 3 according to an eighth embodiment. The antenna apparatus 3 of the eighth embodiment differs from that of the first embodiment in the structure of the antenna element 33. Therefore, the structure of the antenna element 33 will be described.

As shown in FIG. 14, the antenna element 33 has an open distal end portion 33A formed thick. By adjusting the thickness of the end portion 33A of the antenna element 33, high impedance matching can be easily realised during resonance in the 2.0 GHz band.

Ninth Embodiment

Figure 15:
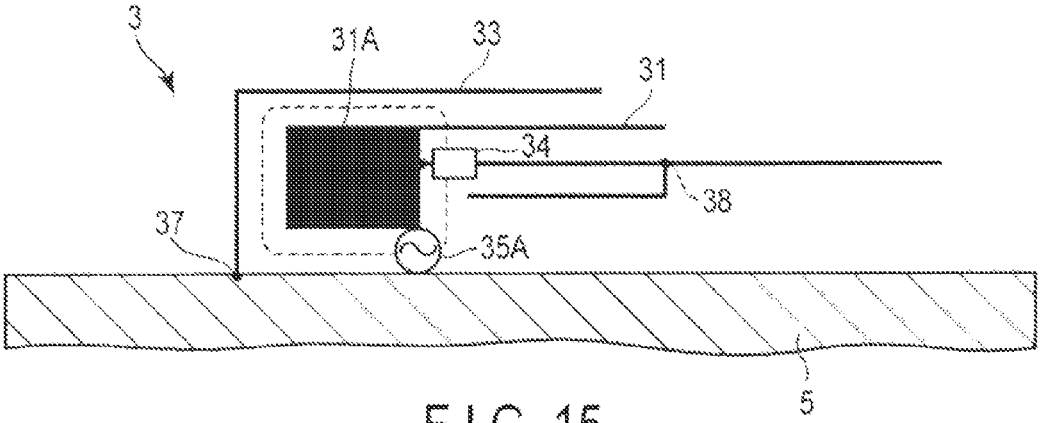
FIG. 15 shows a structure example of an antenna apparatus according to a ninth embodiment.

FIG. 15 shows a structure example of an antenna apparatus 3 according to a ninth embodiment. The antenna apparatus 3 of the ninth embodiment differs from that of the first embodiment in the structure of the antenna element 31. Therefore, the structure of the antenna element 31 will be described.

As shown in FIG. 15, the antenna element 31 has a thick portion 31A. More specifically, the portion 13A is located near the feed terminal 35A. By adjusting the thickness of the portion 13A near the feed terminal 35A, high impedance matching can be easily realised during resonance in the 1.8 GHz band.

Tenth Embodiment

Figure 16:
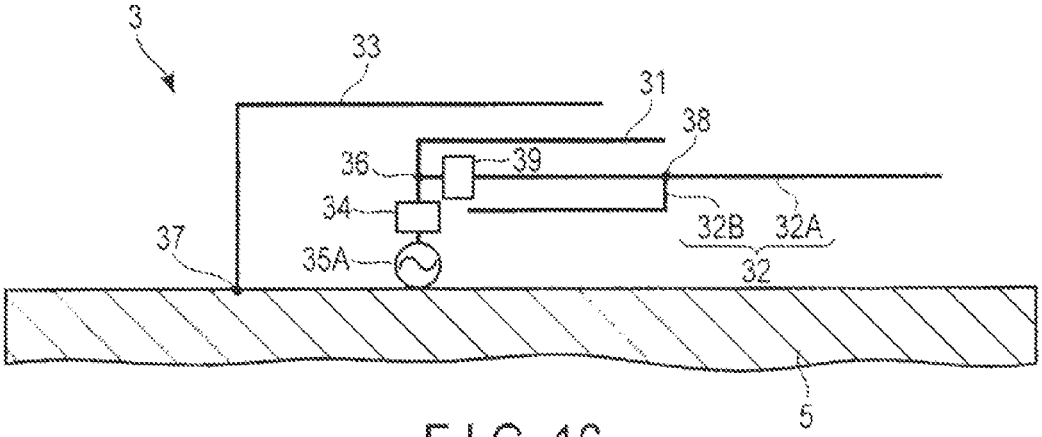
FIG. 16 shows a structure example of an antenna apparatus according to a tenth embodiment.

FIG. 16 shows a structure example of an antenna apparatus 3 according to a tenth embodiment. The antenna apparatus 3 of the seventh embodiment differs from that of the first embodiment in the structure at the bifurcated element 32. Therefore, the structure of the bifurcated element 32 will be described.

As shown in FIG. 16, a concentrated constant element 39 is provided across the bifurcated element 32. More specifically, the concentrated constant element 39 is provided across the bifurcated element 32 near the first point 36.

By providing the concentrated constant element 39 near the first point 36, high impedance matching can be easily realised during resonance in the 800 MHz band and the 2.6 GHz band.

Eleventh Embodiment

Figure 17:
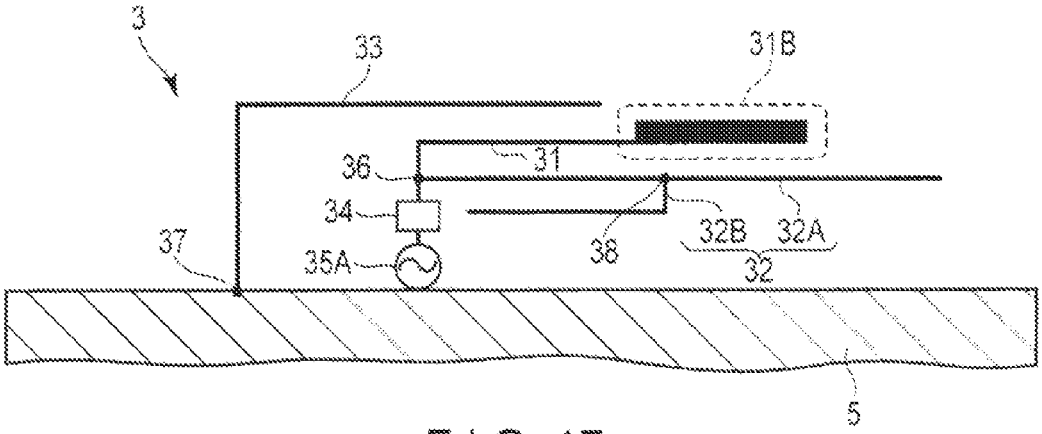
FIG. 17 shows a structure example of an antenna apparatus according to an eleventh embodiment.

FIG. 17 shows a structure example of an antenna apparatus 3 according to an eleventh embodiment. The antenna apparatus 3 of the ninth embodiment differs from that of the first embodiment in the structure of the antenna element 31. Therefore, the structure of the antenna element 31 will be described.

As shown in FIG. 17, the antenna element 31 has a distal open end 310 formed thick. By adjusting the thickness of the distal end 31B of the antenna element 31, high impedance matching can be easily realized during resonance in the 1.8 GHz band.

Twelfth Embodiment

Figure 18:
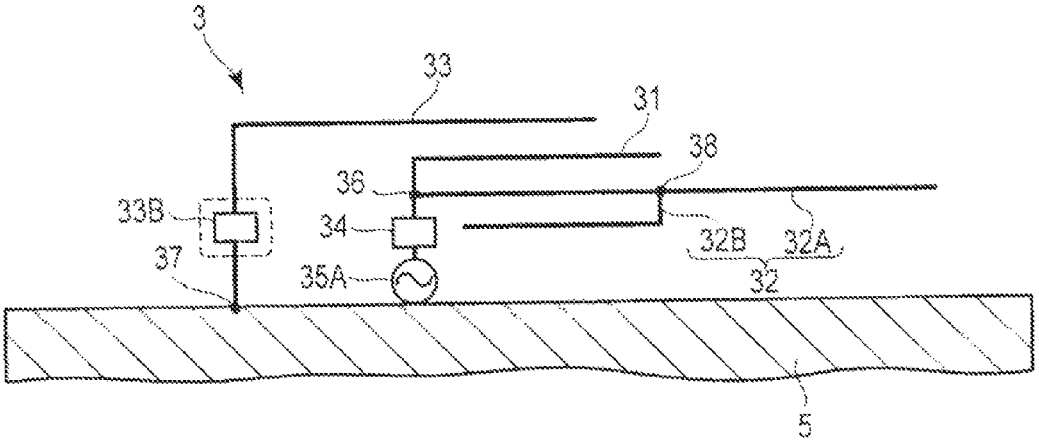
FIG. 18 shows a structure example of an antenna apparatus according to a twelfth embodiment.

FIG. 18 shows a structure example of an antenna apparatus 3 according to a twelfth embodiment. The antenna apparatus 3 of the twelfth embodiment differs from that of the first embodiment in the structure of the antenna element 33. Therefore, the structure of the antenna element 33 will be described.

As shown in FIG. 18, a concentrated constant element 33B is provided across the antenna element 33. In the twelfth embodiment, the concentrated constant element 33B is provided near the passive terminal 37.

By thus providing the concentrated Constant element 33 across the antenna element 33, high impedance matching can be easily realized during resonance in the 2.0 GHz band.

Thirteenth Embodiment

Figure 19:
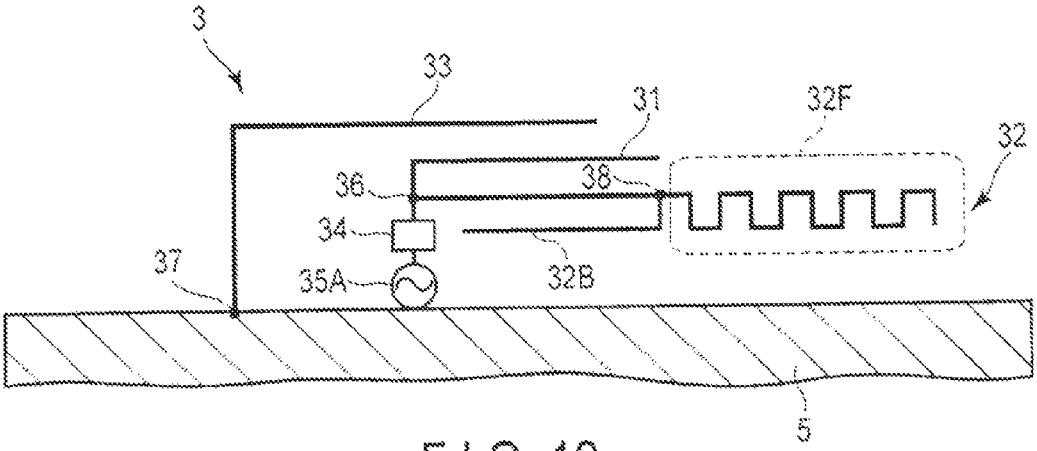
FIG. 19 shows a structure example of an antenna apparatus according to a thirteenth embodiment.

FIG. 19 shows a structure example of an antenna apparatus 3 according to a thirteenth embodiment. The antenna apparatus 3 of the thirteenth embodiment differs from that of the first embodiment in the structure of the bifurcated element 32. Therefore, the structure of the bifurcated element 32 will be described.

As shown in FIG. 19, the distal end of the linear portion 32A of the bifurcated element 32 is angled in several positions. More specifically, the distal end is made to meander.

By making the distal end of the linear portion 32A to meander, the electrical length for resonance in the 800 MHz band can be adjusted, and high impedance matching can be easily realized.

Fourteenth Embodiment

Figure 20:
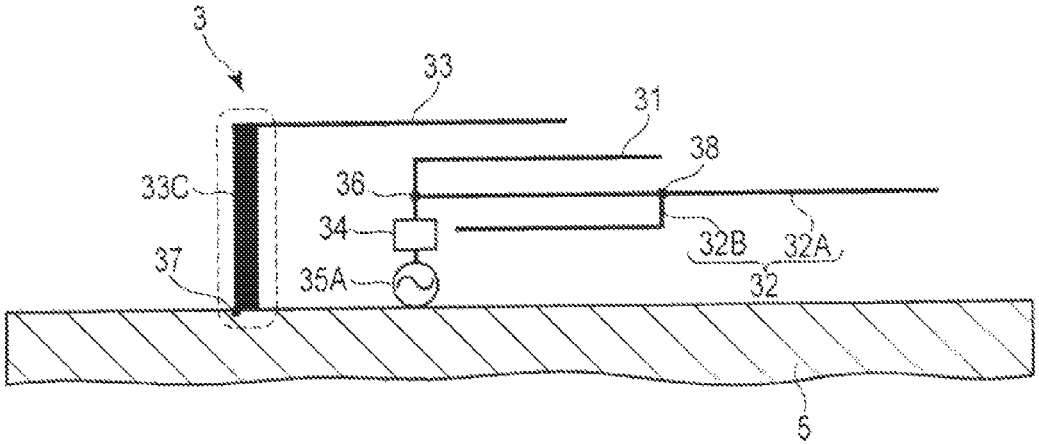
FIG. 20 shows a structure example of an antenna apparatus according to a fourteenth embodiment.

FIG. 20 shows a structure example of an antenna apparatus 3 according to a fourteenth embodiment. The antenna apparatus 3 of the fourteenth embodiment differs from that of the first embodiment in the structure of the antenna element 33. Therefore, the structure of the antenna element 33 will be described.

As shown in FIG. 20, the portion of the antenna element 33 near the passive terminal 37 is formed thick. In the fourteenth embodiment, the portion of the antenna element 33 from the passive terminal 37 to the angled portion thereof is formed thick.

By thus forming the element 33 thick near the passive terminal 37, high impedance matching can be easily realized during resonance in the 2.0 GHz band.

In the first to fifth embodiments, the case is described where the bifurcated element 32 is connected to the feed point 35 of the high-frequency cable 6 extending along the stepped portion 5A of the ground pattern 5. Further, in the sixth to fourteenth embodiments, the case where the bifurcated element 32 is connected to the feed point 35A of the ground pattern 5 is described. However, the bifurcated element 32 described in the first to fourteenth embodiments is applicable to any structure described above and associated with the ground pattern.

In addition, although the first to fourteenth embodiments are directed to the case where the antenna element 31 resonates in a bend of a higher frequency (1.8 GHz) than in a band (2.0 GHz band) in which the antenna 33 resonates, the antenna element 31 may resonate in a lower frequency band than that where the antenna element 33 resonates. In this case, the antenna apparatus 3 can smoothly shift a resonance mode to a 2.6 GHz band resonance mode. Thus, the antenna apparatus 3 can obtain a wider-bandwidth compatibility.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna apparatus comprising:

a first antenna element having an end connected to a feed terminal and another end kept open, an element length from the feed terminal to the another end being set to substantially a quarter of a wavelength corresponding to a preset first resonance frequency; and a second antenna element having an end connected to a first point of the first antenna element, and having a first other end and a second other end kept open, the second antenna element including a first antenna portion and a second antenna portion, the first antenna portion extending from the feed terminal to the first other end, an element length of the first antenna portion being set to substantially a quarter of a wavelength corresponding to a preset second resonance frequency, the second antenna portion extending from the feed terminal and bifurcated from the first antenna portion at a second point between the first point and the first other end at the path of the first antenna portion, an element length of the second antenna portion being set to substantially ¾ of a wavelength corresponding to a preset third resonance frequency; and a capacitor element provided between the feed terminal and the first point, wherein the second antenna portion includes a first portion extending from the feed terminal to the second point, and a second portion extending from the second point to the second other end; and the second portion is interposed between the first portion and a ground portion.

2. The antenna apparatus of claim 1, wherein the first antenna portion extends from the first point in parallel with the ground portion; and the second antenna portion extends from the second point perpendicularly to the ground portion, and extends toward the first antenna element in parallel with the ground portion.

3. The antenna apparatus of claim 2, wherein the second other end of the second antenna portion extends toward and perpendicularly to the ground portion.

4. The antenna apparatus of claim 3, further comprising a third antenna element having an end connected to a non-feeding terminal and a distal open end, an element length from the non-feeding terminal to the distal open end being substantially a quarter of a wavelength corresponding to a preset fourth resonance frequency.

5. The antenna apparatus of claim 2, wherein the first other end of the first antenna portion is angled in several positions.

6. The antenna apparatus of claim 2, wherein the first other end of the first antenna portion includes a portion remoter than the first portion from the ground portion, and a portion extending from the remoter portion and closer to the ground portion than the first portion, a distal portion of the closer portion being open.

7. The antenna apparatus of claim 2, wherein the second antenna element includes a short-circuited element between the first antenna portion and the second antenna portion.

8. The antenna apparatus of claim 1, wherein the capacitor element is provided near the feed terminal.

9. An electronic device provided with a wireless transceiver that receives and transmits wireless signals of frequencies corresponding to a plurality of channel frequencies allocated to a wireless system as a communication target, and with an antenna apparatus connected to the wireless transceiver, the antenna apparatus comprises:

a first antenna element having an end connected to a feed terminal and another end kept open, an element length from the feed terminal to the another end being set to substantially a quarter of a wavelength corresponding to a preset first resonance frequency; and a second antenna element having an end connected to a first point of the first antenna element, and having a first other end and a second other end kept open, the second antenna element including a first antenna portion and a second antenna portion, the first antenna portion extending from the feed terminal to the first other end, an element length of the first antenna portion being set to substantially a quarter of a wavelength corresponding to a preset second resonance frequency, the second antenna portion extending from the feed terminal and bifurcated from the first antenna portion at a second point between the first point and the first other end at the path of the first, antenna portion, an element length of the second antenna portion being set to substantially ¾ of a wavelength corresponding to a preset third resonance frequency; and a capacitor element provided between the feed terminal and the first point, wherein the second antenna portion includes a first portion extending from the feed terminal to the second point, and a second portion extending from the second point to the second other end; and the second portion is interposed between the first portion and a ground portion.

10. The electronic device of claim 9, wherein the antenna apparatus further comprises a third antenna element having an end connected to a non-feeding terminal and a distal open end, an element length from the non-feeding terminal to the distal open end being substantially a quarter of a wavelength corresponding to a preset fourth resonance frequency.

* * * * *